United States Patent [19]

Bell, III

[11] 4,060,337

[45] Nov. 29, 1977

[54] CENTRIFUGAL COMPRESSOR WITH A SPLITTER SHROUD IN FLOW PATH

[75] Inventor: Albert H. Bell, III, Birmingham, Mich.

[73] Assignee: General Motors Corporation, Detroit, Mich.

[21] Appl. No.: 728,721

[22] Filed: Oct. 1, 1976

[51] Int. Cl.[2] ..... F01D 5/22

[52] U.S. Cl. ..... 416/186 R; 416/193 R; 416/196 R

[58] Field of Search ..... 416/186, 193 R, 196, 416/183, 179, 185, 194; 415/213, 215

[56] References Cited

U.S. PATENT DOCUMENTS

| | | | |
|---|---|---|---|
| 1,341,653 | 6/1920 | Lee | 416/186 |
| 2,609,140 | 9/1952 | Jonker | 416/186 |
| 2,625,365 | 1/1953 | Moore | 416/186 |
| 2,658,455 | 11/1953 | Seinfeld | 416/186 X |
| 3,719,426 | 3/1973 | Friberg et al. | 416/193 X |

FOREIGN PATENT DOCUMENTS

| | | | |
|---|---|---|---|
| 205,864 | 10/1959 | Austria | 416/186 |
| 765,809 | 11/1954 | Germany | 416/184 |
| 1,164,752 | 3/1964 | Germany | 416/185 |
| 361,209 | 7/1938 | Italy | 416/186 |
| 279,426 | 8/1928 | United Kingdom | 416/186 |

*Primary Examiner*—Everette A. Powell, Jr.
*Attorney, Agent, or Firm*—J. C. Evans

[57] ABSTRACT

A quick response gasifier spool for an automotive gas turbine engine has a shaft with a turbine wheel connected on one end thereof with a row of turbine blades driven by motive fluid from an engine combustor and further has a low inertia centrifugal compressor impeller with a low mass hub secured to the opposite end of the shaft. The impeller has a plurality of separate, free formed blades each having a root segment integrally formed with the hub; the blades including spaced apart radial tip portions joined by a continuous ring of span splitter elements located on the radial extent of each of the blades to prevent flutter between adjacent free blade radial tips and wherein each element of the continuous ring includes a leading edge and a trailing edge joined by a curved segment located along a flow streamline path between each of the individual blades. The ring and individual free formed blades define an open end back configuration on the centrifugal impeller to reduce fluid shear between the back face of the impeller and its rear closure plate.

3 Claims, 6 Drawing Figures

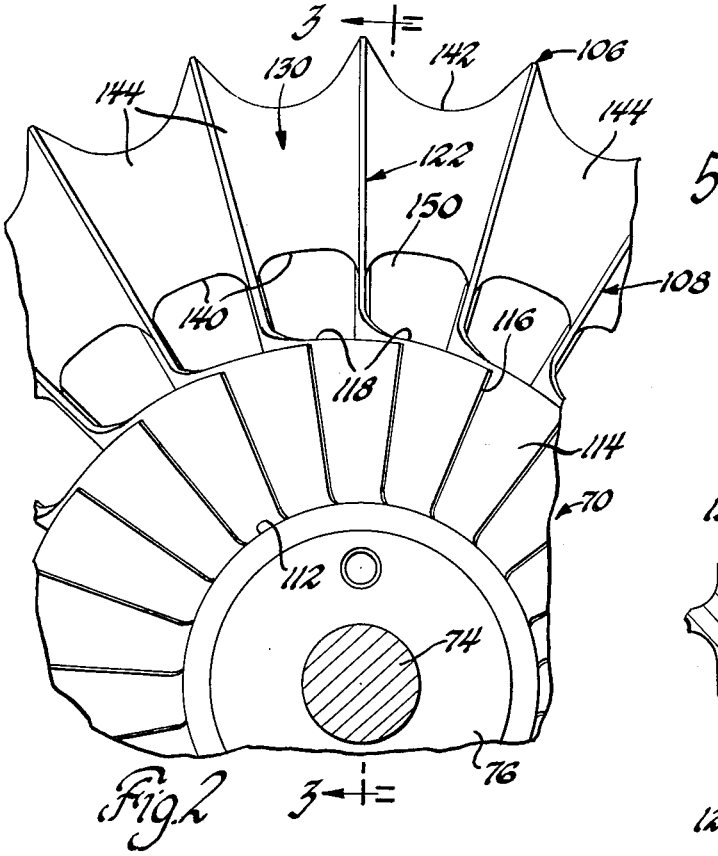
Fig. 2
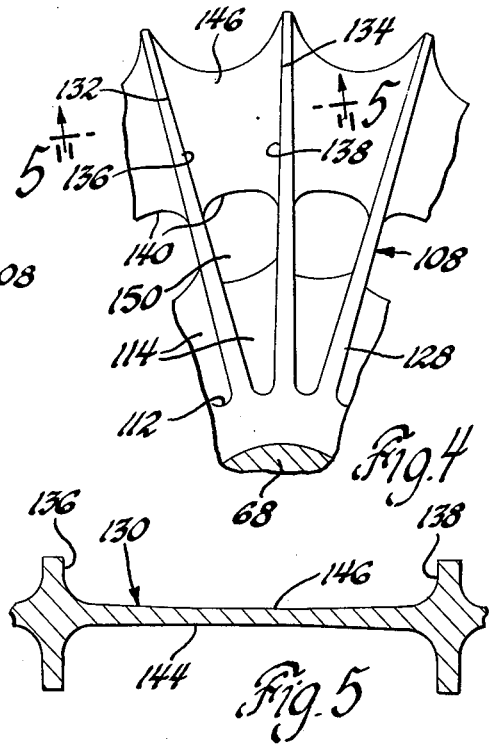
Fig. 4
Fig. 5
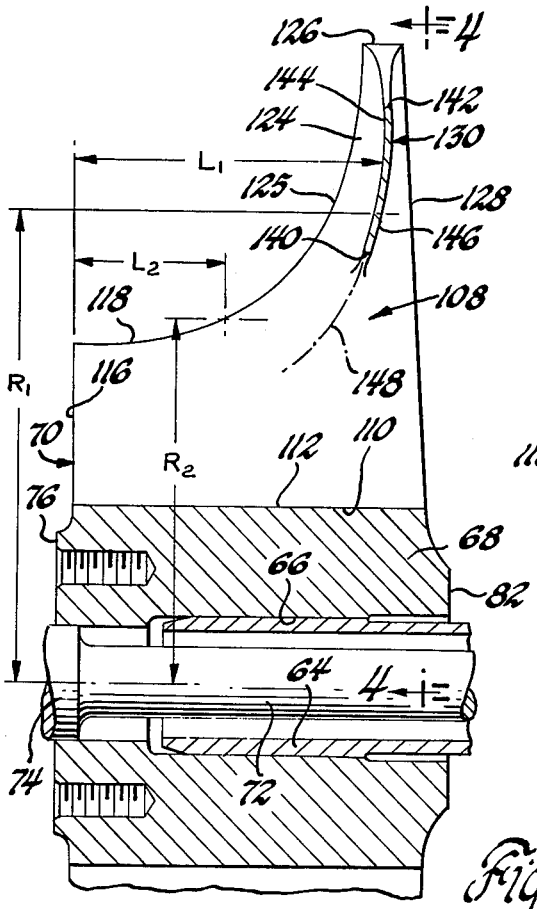
Fig. 3
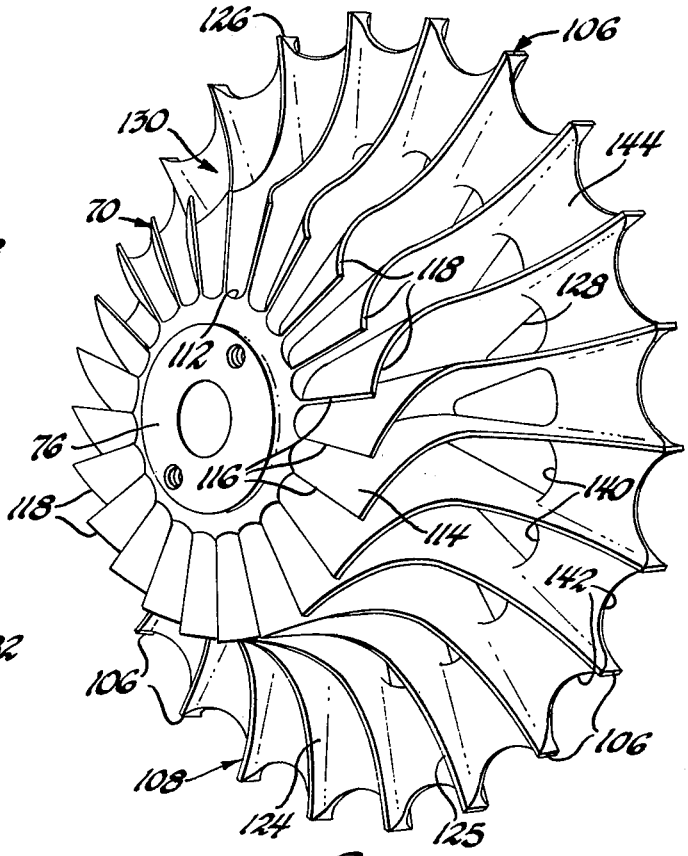
Fig. 6

CENTRIFUGAL COMPRESSOR WITH A SPLITTER SHROUD IN FLOW PATH

This invention relates to gas turbine engines and more particularly to centrifugal compressor impeller configurations for use with a gasifier spool of an automotive gas turbine engine which is driven by combustion products from a combustor burner assembly during vehicle operation.

Gas turbine engines are characterized by the provision of turbine driven gasifier spools including a centrifugal compressor impeller and a turbine blade row having combustion products directed thereacross during engine operation to control vehicle acceleration and deceleration.

One centrifugal compressor impeller configuration suitable for use in gas turbine engine gasifier spools of this type is set forth in U.S. Pat. No. 2,819,012 issued Jan. 7, 1958, to Atkinson. The rotor set forth therein includes an axial flow inducer portion and a radial fluid impeller portion including radial blades each having a root portion integrally formed with a rear impeller plate. This type of impeller has acknowledged compression ratio performance superiority over that of tip shrouded impellers as used in many centrifugal pumps. Such impellers, however, have a substantial mass and polar moment of inertia that reduces engine response to acceleration input signals. Accordingly, gasifier spools with such impellers must be operated at idle speeds which are approximately fifty percent of design speed to get desirable acceleration response. The mass and polar moment of inertia of centrifugal compressor impellers as set forth in the aforesaid Atkinson configuration will tend to delay gasifier spools response enough to require the fifty percent idle speed. Such operation requires increased idle fuel consumption. In order to achieve deceleration response it is also desirable to reduce the mass and polar amount of inertia of the compressor component of the gasifier spool.

Another characteristic of the type of centrifugal compressor set forth in the aforesaid Atkinson patent is that air is trapped between the back plate of the impeller and the impeller enclosure. As the impeller is driven relative to the fixed enclosure such air is subjected to shear to produce a windage loss on the impeller during engine operation. Furthermore, the impeller back plate of the Atkinson type compressor produces thrust forces on the impeller that tend to bend it forwardly in the direction of an inlet and blade tip shroud. As a result, a substantial clearance must be maintained between the compressor impeller and the shroud so as to reduce interference therebetween during the engine operation.

U.S. Pat. No. 2,995,293 issued Aug. 8, 1961, to Buchi, sets forth a centrifugal compressor having a tip shrouded impeller as well as an unshrouded impeller. Both configurations have an integrally formed back plate. The back plate produces windage loss and increases impeller mass and polar moment of inertia. In the Buchi arrangement flow guide vanes are located in the inducer portion of the rotor to smoothly direct inlet flow from an axial inlet into the radially located shrouded or unshrouded impeller portion of the compressor and further increase impeller mass.

Star configured impellers wherein a part of the back plate of the impeller is cut away at its periphery to reduce centrifugal stress at extreme peripheral portions of the impeller back plate are set forth in U.S. Pat. No. 1,957,703, issued May 22, 1934, to Birmann. In such arrangements, the radial outermost tip of an impeller blade of the centrifugal impeller is located with respect to the impeller enclosure to define a radial exhaust flow path from the impeller but only a limited portion of the radial extent of the impeller is free formed and a back plate integrally joins individual blades with resultant increase in mass and polar moment of inertia.

U.S. Pat. No. 2,465,625, issued Mar. 29, 1949, to G. Aue shows a double bladed centrifugal impeller which includes radially outwardly directed double blade segments thereon which have free edges. The impeller diameter increases intermediate the double blades. The increase in hub diameter increases the mass and polar moment of inertia of the design. Another example of an impeller without a back plate is set forth in U.S. Pat. No. 2,658,455, issued Nov. 10, 1953, to Seinfeld. This impeller is intended for use in water pump applications and includes a large mass, flow splitter that extends from the inlet of the individual radial blades to the outlet thereof and adds mass and polar moment inertia in the same way as does a back plate for the impeller.

In each of the aforesaid impeller configurations some consideration is given to removal of metal from outer peripheral portions of the impeller structure to reduce centrifugal stresses at extreme radial points on the impeller. In other cases, particular considerations are given to the flow pattern through the impeller, for example, in the Seinfeld configuration an annular rib is included for smooth guidance of two flow paths adjacent to inner and outer shroud walls of the pump chamber casing. However, each of the aforesaid impellers are characterized by having a substantial mass and polar moment of inertia which is suitable for its intended purpose. None of the aforesaid types of centrifugal compressors are configured to produce an optimized mass and polar moment of inertia which will produce quick response in automotive gas turbine engine applications wherein it is desired to quickly accelerate and decelerate a gasifier spool assembly including a turbine on one end thereof and a centrifugal compressor on the opposite end thereof for supplying air to a combustor assembly in the engine.

Accordingly, an object of the present invention is to improve the operation of automotive gas turbine engines by the provision of a low inertia configured gasifier impeller that enables the turbine engine to be operated at lower idle speeds to reduce idle fuel consumption.

Another object of the present invention is to provide an improved low inertia gasifier impeller for gas turbine engines that includes a partial span across radial blades to reduce the polar moment of inertia of the impeller to enable a gasifier spool of a gas turbine engine to be operated at idle speeds less than forty percent of run speeds thereby to reduce idle fuel consumption of the engine.

Yet another object of the present invention is to provide an improved gas turbine engine gasifier spool assembly that reduces engine idle speed by including a turbine on one end of a shaft and a low inertia centrifugal impeller on the opposite end of the shaft for supplying air from an axial inlet through a radial outlet and compressing it for supply to a combustor burner element of the gas turbine engine and wherein the impeller is configured to have a low mass, constant diameter hub portion with a plurality of separate radially outwardly directed free formed blades thereon each having an axially oriented inducer segment and a radially outwardly directed free blade impeller portion with a free rear edge extending radially from the hub to the tip of each of the blades and open with respect to a housing plate to reduce impeller windage losses and wherein each of the separate free formed blades has a continuously circumferentially formed span splitter element integrally formed between adjacent blade portions to reinforce them against flutter and wherein the cross section of the element is less than that of the free blade portions of the impeller, and wherein the span splitter element includes an inlet edge and an outlet edge and a curved segment therebetween located along flow streamlines between the blade impeller portions with the inlet being spaced radially from the constant diameter hub by a distance greater than the height of the inlet edge of the inducer segment of the impeller blade.

Still another object of the present invention is to improve responsiveness of a gasifier spool in a gas turbine engine by the provision of a shaft having a turbine on one end thereof and a low inertia compressor impeller on the opposite end thereof having a minimal polar moment of inertia by provision of an impeller hub having a constant diameter throughout the full axial extent thereof and by the further provision of a plurality of separate free formed, radially extending blades with an unattached rear edge from the hub to the tip of the blade portion; and wherein each of the free blade tip portions are secured to an adjacent one by means of a span splitter element having a cross section no greater than the cross section of each of the individual radially extending blade portions; said element having an inlet edge located radially outwardly of the impeller to form an open-ended back-configuration on the impeller; the element being curved on streamlines in a flow passage between each of the separate blades at a point forwardly of the rear plane of the impeller and at a flow velocity region lower than that of the rear plane of the impeller so as to reduce friction losses and to reduce boundary layer thickness in the fluid flow through the impeller during its operation.

Yet another object of the present invention is to provide a low inertia centrifugal compressor having a hub with a constant diameter from the inlet end of the impeller to the rear plane thereof for reducing the polar moment of inertia of the impeller and including a plurality of separate, radially outwardly directed free formed blades each having a root portion integrally formed with the hub and including a free radially outwardly extending tip portion spaced with respect to adjacent blade tip portions and by the further provision of a span splitter element having a cross section less than that of each of the blades and extending between each of the blades to reinforce adjacent blades against flutter; and wherein the span splitter element includes an inlet edge spaced radially outwardly of the hub a distance greater than the blade tip height at the impeller blade inlet and including an outlet edge thereon extending from the tip of each of the blade and being formed radially inwardly along a constant radius path so as to minimize the polar moment inertia of the span splitter element and wherein each of the span splitter elements is curved along a streamline in an impeller flow passage between each of the blades at a point forwardly of the rear plane of the impeller to minimize boundary layer thickness of fluid flow through the impeller and wherein the free formed blades and elements define a large, open area back configuration between the impeller flow passages and the rear plane of the impeller to reduce windage losses between the impeller and its housing.

Further objects and advantages of the present invention will be apparent from the following description, reference being had to the accompanying drawings wherein a preferred embodiment of the present invention is clearly shown.

FIG. 2 is an enlarged, fragmentary sectional view taken along the line 2—2 of FIG. 1 looking in the direction of the arrows;

FIG. 3 is a fragmentary sectional view taken along the line 3—3 of FIG. 2 looking in the direction of the arrows;

FIG. 4 is a fragmentary sectional view taken along the line 4—4 of FIG. 3;

FIG. 5 is an enlarged cross sectional view taken along the line 5—5 of FIG. 4 looking in the direction of the arrows; and FIG. 6 is a view in perspective of the low inertia centrifugal compressor of the present invention.

Figure 1:
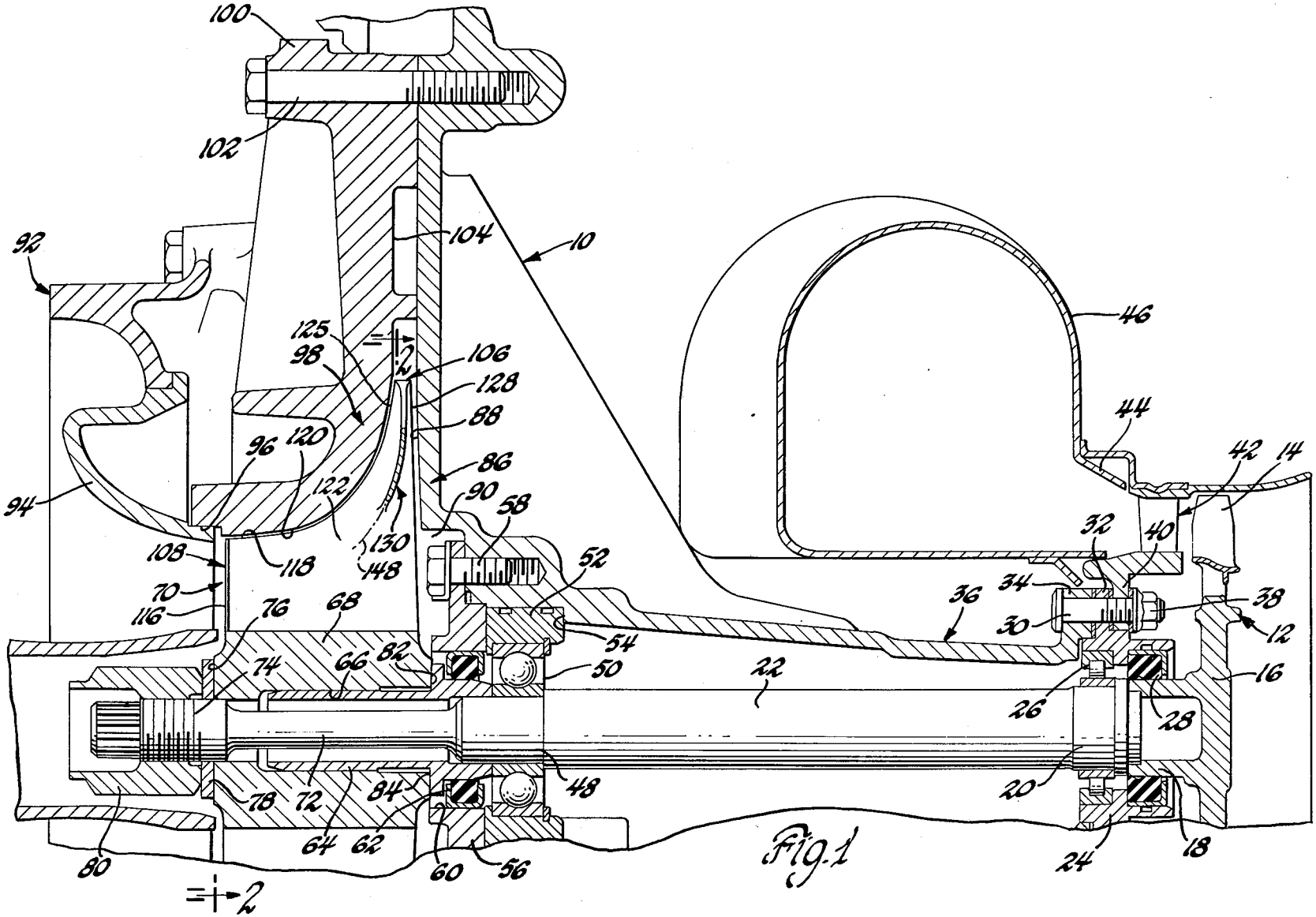
FIG. 1 is a fragmentary, longitudinal cross sectional view of a gas turbine engine spool including the present invention.

Referring now to FIG. 1, a gasifier spool assembly 10 is illustrated for use with a gas turbine engine of the type including a combustor burner assembly having air and fuel directed thereto for burning to produce motive fluid for the turbine. In the illustrated arrangement, the spool assembly 10 includes a turbine 12 having a circumferential row of radially directed turbine blades 14 thereon connected to a rotor disk 16 with a hub extension 18 connected to the outboard end 20 of a drive shaft 22. The outboard end 20 is circumferentially surrounded by a seal and bearing support member 24 that supportingly receives a bearing assembly 26 for rotatably supporting the outboard end 20. The support member 24 carries an outboard seal assembly 28 for sealing the end of the shaft 22.

A plurality of fastening means in the form of bolts 30 are directed through a radial flange 32 on the support member 24 and through a flange 34 on the end of an engine housing 36. Bolts 30 each threadably receive a lock nut 38 located against the outboard face of a radially inwardly directed flange 40 on a nozzle assembly 42 for directing combustion products across the turbine blade row 14. In the illustrated arrangement the nozzle assembly 42 is downstream of the outlet 44 of a transition duct 46 for supplying combustion products from a turbine engine combustor burner element (not shown).

The opposite end of the shaft 22 has a reduced diameter portion 48 thereon supportingly received by a bearing assembly 50 located within a ring 52 held in place by an undercut shoulder 54 on the housing 36 by means of a retainer plate 56 having a flange portion thereon secured to the housing 36 by suitable fastening means shown as screws 58. The plate 56 has a bore 60 therein supportingly receiving a seal assembly 62 that engages an inboard peripheral end of a bushing 64 press fit within a bore 66 which extends axially through the hub 68 of a low inertia centrifugal compressor impeller 70 constructed in accordance with the present invention.

A small diameter shaft extension 72 extends from shaft 22 through the bushing 66 and includes a threaded end portion 74 located outboard of an inlet end 76 of the hub 68. A washer 78 engages the inlet end 76 and a nut 80 is threadably received on the threaded end portion 74 for securing the back wall 82 of the hub 68 against a shoulder 84 on the bushing 64.

In the illustrated arrangement the housing 36 includes a radially outwardly directed plate portion 86 thereon with an inboard surface defining the rear wall 88 of a pump chamber 90 having an axial inlet defined by a housing cover insert 92 including a radially inwardly convergent surface 94 that directs inlet air flow to the low inertia centrifugal compressor impeller 70. The cover insert 92 is seated in a shoulder 96 of a compressor cover 98 that has a radially outwardly directed flange 100 thereon secured to the plate 86 by suitable fastening means representatively shown as screw elements 102, one of which is shown in FIG. 1.

The cover 98 has a diffuser channel 104 formed therein at a point radially outwardly from the outer periphery 106 of the impeller 70. The aforedescribed gas turbine engine spool assembly 10 is representative of an assembly that has an improved performance by virtue of the impeller 70 to be described. The spool assembly is characterized as being driven by motor fluid through the nozzle 46 having a temperature in the order of 1800° F. During a vehicle acceleration mode it is desirable to increase the speed of rotation of the turbine 12, shaft 22 and the associated centrifugal impeller 70 from idle speed to design speed promptly. In order to accomplish this objective it is necessary to reduce the polar moment inertia of the impeller 70 substantially as compared to conventional unshrouded centrifugal impellers. For example an Atkinson type impeller modified to have the unique form and shape of the present invention has its inertia substantially reduced to meet the aforesaid objectives. The reduction is accomplished without sacrifice of flow stability during engine operation.

In accordance with principles of the present invention this is accomplished by means of an improved configuration of the centrifugal impeller 70. The configuration is set forth in detail in FIGS. 2 through 6. In this arrangement the hub 68 of the impeller 70 is maintained at a substantially constant diameter from the inlet end 76 thereof to the back end 82; any deviation being that required for process. The impeller 70 is of a unitary construction formed as a single casting. It includes a plurality of circumferentially spaced thin sectioned, free formed, separate blades 108. Each blade 108 has a root 110 integrally formed with the outer periphery 112 of the hub 68. Each blade 108 also includes an inducer segment 114 at its inlet end with an inlet edge 116 extending from the hub periphery 112 in a straight radial direction to an outer radial tip 118 on the inducer segment 114 located in close, spaced relationship to a curved shroud surface 120 formed on the inside of the cover 98 as best seen in FIG. 1.

The inducer segment 114 is representatively illustrated as being curved in the direction of blade rotation, which is clockwise as shown in FIG. 2, to induce inlet air flow through the insert 92 into flow passages 122 formed between each of the blades 108. The inducer segments 114 are turned from the inlet edge 116 in an axial direction, as shown in FIG. 2, to merge with a radial flow impeller portion 124 on each of the blades 108 including a radially outer curved tip segment 125 located in close spaced relationship with the surface 120 and being formed continuously with the tip 118. The tip 125 curves in a radial direction to intersect a peripheral tip 126 on each of the blades 108. Each of the blades 108 further includes a free rear radial edge 128 thereon extending from the outer periphery 112 to the tip 126. The edge 128 of each of the blades 108 is spaced axially from the inboard surface 88 and also is spaced with respect to an adjacent edge 128 so that fluid flow through the impeller 70 is completely open to the surface 88 of the plate 86 to prevent entrapment of fluid flow in that region so as to reduce windage losses during rotation of the impeller 70 with respect to the back plate 86.

The provision of a constant diameter rotor hub 68 and thin sectioned, radially outerly directed free individual blades 108 substantially reduces the polar moment of inertia of the impeller 70. However, the individual blades 108, because of their free form, are each interconnected by means of a span splitter element 130 located continuously around the impeller 70 to form a partial span shroud ring reinforcement against flutter between adjacent ones of the free formed blades 108 at the tips 126 thereof.

More particularly, the span splitter elements 130 each have spaced apart root segments 132, 134 integrally formed with spaced side walls 136, 138 of the radial impeller portion 124 of adjacent blades 108. The individual span splitter elements 130 are formed continuously between each of the blades to form a circumferential ring through the impeller 70 at a point radially outwardly of portions 124 and axially forwardly of surface 88 as shown in FIGS. 1 and 3.

As shown in FIG. 5, the thickness of each of span splitter elements 132 is of a cross section no greater than that of the individual blades 108. Moreover, the location of each of the span splitter elements 130 is at a point radially outwardly of the impeller 70 to provide a strong reinforcement of adjacent blade peripheral tips 126 to prevent flutter therebetween upon impeller rotation. The mass of the elements 130 is minimized by the overall radial height of each element 130 by locating an inlet edge 140 on each of the elements 130 at a point spaced radially outwardly of the outer periphery 112 a distance greater than the height of the inlet edge 116. In the illustrated arrangement, the inlet edge 140 is located on the radial portion 124 radially outwardly of its midpoint. Each element 130 further includes an outlet edge 142 formed along a curved line that intersects each of the tips 126 and of a radius to reduce the amount of bridge element mass at the outer periphery 106 of the impeller. Accordingly, the elements 130 serve as a means for reinforcing the radial portion 122 of each of the blades 108 without substantially increasing the polar moment of inertia of the impeller 70.

The span splitter elements 130 further serve a flow direction function in the illustrated arrangement so as to guide air flow through each of the passages 122 as it makes a transition from the inducer segments 114 to the radial impeller portions 124. Accordingly, the elements 130 include a concavely curved, forwardly faced surface 144 from the inlet edge 140 to the outlet edge 142 and a convexly curved surface 146 on the rear of each of the elements 130. The surfaces 144, 146 are curved along flow streamlines, shown at 148 in FIGS. 1 and 3, through the flow passages 122 formed between each of the free, separate, blade elements 108. The streamlines 148 are located forwardly of a rear plane including the rear radial edges 128 of the individual blades 108 in a flow velocity region which is lower than that of air flow at the rear axial extent of impeller portions 124. It is observed that this location of the flow splitting surfaces 144, 146 on each element 130 will reduce fluid boundary layer thickness in this region of the impeller during its operation and will also minimize frictional losses.

The radial and axial location of the mean line of the span splitter element of one working embodiment 130 is set forth in the following schedule wherein the $R_1$ radius represents the radial distance from the center line of the impeller to the mean line of the span splitter 130 and the $L_1$ dimension represents the axial distance of the splitter mean line from the inlet edge 116 of the blade to the mean line of the bridge splitter 130. The following figures are representative of one working embodiment and are not limiting, it being understood that exact contour will depend on each given application.

| $R_1$ | $L_1$ |
|---|---|
| 2.6246 | 1.8713 |
| 2.7534 | 1.9216 |
| 2.9167 | 1.9694 |
| 3.1021 | 2.0080 |
| 3.2753 | 2.0330 |
| 3.4552 | 2.0507 |
| 3.6404 | 2.0620 |
| 3.8310 | 2.0670 |
| 4.0200 | 2.0670 |
| 4.2240 | 2.0670 |

This splitter mean line is located on a blade having a contour for tips 118 and 125 as represented by the following schedule and wherein the $R_2$ dimension represents the distance of the tips 118, 125 from the center line of the impeller at a corresponding axial length $L_2$ from the inlet edge 116.

| $R_2$ | $L_2$ |
|---|---|
| 2.2390 | 0 |
| 2.2464 | .2719 |
| 2.2740 | .5681 |
| 2.3444 | .8580 |
| 2.4671 | 1.1302 |
| 2.6464 | 1.3691 |
| 2.8750 | 1.5616 |
| 3.1382 | 1.7039 |
| 3.4224 | 1.8000 |
| 3.7180 | 1.8573 |
| 3.9240 | 1.8803 |
| 4.1487 | 1.9011 |

The aforedescribed improved impeller has no impeller back plate and the specific configuration of the span splitter elements 130 between each of the free radial blade impeller portions 124 along with a constant diameter hub 68 reduces the mass and polar moment of inertia of the impeller 70 to improve engine response. Furthermore, the elimination of the back plate and the specially formed span splitter elements 130 reduce the wetted area of air flow through the impeller at the rear thereof thereby to reduce friction losses of air flow through the flow passages 122 and to maintain a thinner boundary layer in the main stream.

Furthermore, the blades 108 and the span splitter elements 130 define large area openings 150 to the rear of the impeller 70 to reduce windage losses between the end of the impeller 70 and the back plate surface 88.

The specific blade and splitter configuration will produce a higher adiabatic efficiency in the compression process through the impeller 70. Furthermore, the specific configuration set forth above improves manufacturing of the blade assembly in that an impeller 70 can be cast as a single piece merely by providing a part line along the mold casting at the splitter element 130.

A further feature is that the air flow across the bridge splitter element 130 materially reduces the thrust forces acting on the impeller which forces cause the rotor to bend forwardly with respect to the axis of the shaft 22. Thus, the clearance between the shroud surface 120 and impeller blade tips 118, 125 can be reduced for improved compressor efficiency as well as to maintain a greater structural integrity in the impeller itself.

While the embodiments of the present invention, as herein disclosed, constitute a preferred form, it is to be understood that other forms might be adopted.

The embodiments of the invention in which an exclusive property or privilege is claimed are defined as follows:

1. A low inertia centrifugal rotary compressor impeller of unitary construction for association with a gasifier turbine and wherein the gasifier turbine is driven by motive fluid to accelerate the impeller comprising: an impeller hub having means for connection to a gasifier turbine shaft, a plurality of blades on said hub each having a root portion integrally connected to the outer periphery of the hub and defining a flow passage with an adjacent blade, each of said blades including a free rear edge portion directed essentially radially outwardly of the hub and being circumferentially spaced with respect to an adjacent blade free rear edge portion to define a rear opening through the impeller at the hub from each of the flow passages to reduce windage losses during impeller operation, a flow splitter ring formed continuously circumferentially around the impeller and being integrally formed with each of the separate blades, said flow splitter ring having an inlet edge located at the transition of axial to radial flow through the impeller and including an outlet edge located adjacent the outer periphery of the circumferentially spaced blades of the impeller, said flow splitter ring interconnecting each of the separate blade members to prevent blade flutter during impeller rotation, said splitter ring being located in the flow passage between each of the separate blades and at a point forwardly of the rear plane of the impeller.

2. A gasifier spool assembly for a gas turbine engine comprising: a gasifier turbine driven by motive fluid, a low inertia centrifugal compressor having an impeller with a hub, a shaft connected to said turbine, said hub having means for connection to said shaft, a plurality of separate free formed blades on said hub each having a root portion integrally connected to the outer periphery of the hub and defining a flow passage with an adjacent blade, each of said blades including a free rear edge portion directed essentially radially outwardly of the hub and being circumferentially spaced with respect to an adjacent blade free rear edge portion to define a rear opening through the impeller at the hub from each of the flow passages to reduce windage losses during impeller operation, a flow splitter ring formed continuously circumferentially around the impeller being integrally formed with each of the separate blades, said flow splitter ring having an inlet edge located at the transition of axial to radial flow through the impeller and including an outlet edge located adjacent the outer periphery of said blades, said flow splitter ring interconnecting each of the separate blade members to prevent blade flutter during impeller rotation, said splitter ring being located along a streamline in the flow passage between each of the separate blades and at a point forwardly of the rear plane of the impeller, said splitter ring having a cross section thickness, height and width to minimize the polar moment of inertia of said impeller whereby the gasifier spool assembly can be operated at an idle speed between 35%–40% of the spool design speed while maintaining engine response.

3. A low inertia centrifugal rotary impeller of unitary construction for association with a gasifier turbine of a gas turbine engine gasifier spool and wherein the gasifier turbine is driven by motive fluid to accelerate the impeller comprising: an impeller hub portion, means for connecting said hub portion to the gasifier turbine shaft, a plurality of circumferentially spaced, separate free formed blades on said hub each having a root portion integrally connected to the outer periphery of said hub and defining a flow passage with an adjacent blade, each of said blades including an inlet inducer with an inlet edge, each of said blades having a radial impeller portion with a free rear edge directed radially outwardly of the hub and being circumferentially spaced with respect to an adjacent blade free rear edge portion to define a rear opening through the impeller at the hub from each of the flow passages to reduce windage losses during impeller operation, a splitter ring formed continuously circumferentially around the impeller being integrally formed with each of the separate blades at the periphery of said radial impeller portions, said splitter ring having an inlet edge located radially outwardly of the tip of the inlet edge and including an outlet edge located adjacent the outer periphery of the circumferentially spaced blades of the impeller, said splitter ring interconnecting each of the radial impeller portions of said separate blades to prevent blade flutter therebetween during impeller rotation, said splitter ring being located along a streamline in the flow passage between each of the separate blades and at a point forwardly of the rear plane of the impeller layer, said splitter ring having a cross section thickness, height and width to minimize the polar moment of inertia of said impeller whereby the gasifier spool assembly can be operated at an idle speed between 35%–40% of the spool design speed while maintaining engine response.

* * * * *